US010723603B1

(12) United States Patent
Curtis et al.

(10) Patent No.: US 10,723,603 B1
(45) Date of Patent: Jul. 28, 2020

(54) OFF-ROAD JACK

(71) Applicants: Matthew James Curtis, Redlands, CA (US); William Ryczek, LaVerne, CA (US)

(72) Inventors: Matthew James Curtis, Redlands, CA (US); William Ryczek, LaVerne, CA (US)

(73) Assignee: Matthew James Curtis, Redlands, CA (US)

( * ) Notice: Subject to any disclaimer, the term of this patent is extended or adjusted under 35 U.S.C. 154(b) by 73 days.

(21) Appl. No.: 16/216,462

(22) Filed: Dec. 11, 2018

(51) Int. Cl.
*B66F 3/00* (2006.01)
*B66F 3/30* (2006.01)
*B66F 3/24* (2006.01)

(52) U.S. Cl.
CPC ..... *B66F 3/30* (2013.01); *B66F 3/247* (2013.01)

(58) Field of Classification Search
CPC ..... B66F 1/00; B66F 1/06; B66F 1/08; B66F 3/00; B66F 5/00; B66F 2/30; B66F 3/247; F16L 3/00; F16L 3/16
See application file for complete search history.

(56) References Cited

U.S. PATENT DOCUMENTS

| | | | | |
|---|---|---|---|---|
| 1,499,280 | A | 6/1924 | Alheit | |
| 2,327,180 | A | 8/1943 | Diercksmeier | |
| 2,493,978 | A | 1/1950 | Kromer | |
| 2,738,952 | A | 3/1956 | Nilson | |
| 2,774,567 | A | 12/1956 | Shroyer | |
| 3,240,471 | A | 3/1966 | Townsend | |
| 3,313,505 | A * | 4/1967 | Petrie | B25H 1/00 248/165 |
| 3,314,655 | A | 4/1967 | Steele | |
| 3,415,490 | A | 12/1968 | Steele | |
| 3,606,254 | A | 9/1971 | Olson | |
| 3,741,509 | A | 6/1973 | Kelley | |
| 4,402,487 | A * | 9/1983 | Donnelly | B66F 13/00 254/101 |
| 4,556,163 | A | 12/1985 | Lundman | |
| 4,690,361 | A | 9/1987 | Lundman | |
| 5,165,665 | A | 11/1992 | Jolivette, Sr. | |
| 6,375,135 | B1 | 4/2002 | Eason et al. | |
| 6,748,873 | B2 * | 6/2004 | Brown, Sr. | A47B 3/10 108/49 |
| D527,509 | S | 8/2006 | Johns | |
| 7,143,998 | B1 * | 12/2006 | Hall | B66F 3/08 254/98 |
| 8,231,108 | B2 * | 7/2012 | Realegeno-Amaya | B66D 1/08 254/134 |
| 8,646,731 | B2 * | 2/2014 | Burles | F16L 3/16 144/287 |
| 2015/0298947 | A1 * | 10/2015 | Davis | B66F 3/30 254/89 H |
| 2015/0030164 | A1 | 11/2015 | Fey et al. | |

* cited by examiner

*Primary Examiner* — Lee D Wilson
(74) *Attorney, Agent, or Firm* — Eric Karich; Karich & Associates

(57) ABSTRACT

A jack has a lifting post, a pair of side legs, adjustable leg extensions, and leg locking mechanisms for locking the leg extensions with respect to the side legs. The lifting post has a bottom element and a top element that slide with respect to each other, and a vehicle engaging hook mounted on the top element. A lifting mechanism lifts the top element with respect to the bottom element, once the side legs have been adjusted.

12 Claims, 6 Drawing Sheets

OFF-ROAD JACK

BACKGROUND OF THE INVENTION

Field of the Invention

This invention relates generally to vehicle lifting jacks, and more particularly to a vehicle lifting jack that is adapted for use on irregular surfaces, such as during off-road use.

Description of Related Art

The prior art teaches a range of different forms of jacks for lifting vehicles and the like. For example, Diercksmeier, U.S. Pat. No. 2,327,180, teaches a tripod jack that includes a center post and three side support legs. The center post includes a hydraulic ram that includes a plunger that rises from the center post rises when fluid is injected under pressure through a side port. The pump may be mounted on one of the side support legs, and connected to the port via a flexible tube.

Kelley, U.S. Pat. No. 3,741,509, teaches a similar tripod type pipe jack assembly that includes three support legs that fold outwardly to support a center post. A threaded rod telescopically engages the center post for raising and lowering the jack. A cam mechanism is included to maintain the legs in their folded side-by-side relation with the body of the jack thereby rendering the assembly easier to transport and store.

Hall, U.S. Pat. No. 7,143,998, teaches a vibration absorber jack including a tripod type base, a jack, an absorber positioning mechanism, and a vibration absorber holder. The jack is attached to the base, the absorber positioning mechanism is disposed on top of the jack, and the vibration absorber holder is attached to the absorber positioning mechanism such that the vibration absorber holder can be positioned and moved by the absorber positioning mechanism.

The prior art teaches various forms of tripod jacks that are suitable for use on stable, level ground. However, the prior art does not teach a jack having the present construction which enables effective and safe use in an off-road environment, with uneven and unstable ground. The present invention fulfills these needs and provides further advantages as described in the following summary.

SUMMARY OF THE INVENTION

The present invention teaches certain benefits in construction and use which give rise to the objectives described below.

The present invention provides a jack that includes the following: a lifting post having a bottom element and a top element, the bottom element having a support base and an upwardly extending portion, the top element having a vehicle engaging hook; the top element being slidably mounted on the bottom element so that the top element slides longitudinally up and down on the bottom element, thereby raising and lowering the vehicle engaging hook between a lowered position and a raised position; a lifting mechanism for lifting the top element with respect to the bottom element; a pair of side legs, each secured with a pivot to the bottom element and extending downwardly to a lower end; and a pair of leg extensions, each slidably mounted on the lower end of one of the side legs and extending to a support base. Each of the side legs and attached leg extensions pivoting between a collapsed position closely adjacent the lifting post, and an extended position wherein the side legs and leg extensions extend outwardly and downwardly for supporting the lifting post. A pair of leg locking mechanisms may also be included, each for locking one of the leg extensions with respect to the side leg, so that they remain in the extended position.

A primary objective of the present invention is to provide a jack having advantages not taught by the prior art.

Another objective is to provide a jack that be adjusted to accommodate irregular terrain, so that the jack provides superior stability and safety than prior art jacks.

A further objective is to provide a is easy to adjust and use, even when used in difficult, outdoor conditions.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a vehicle lifting jack 10 for lifting a vehicle.

Figure 1:
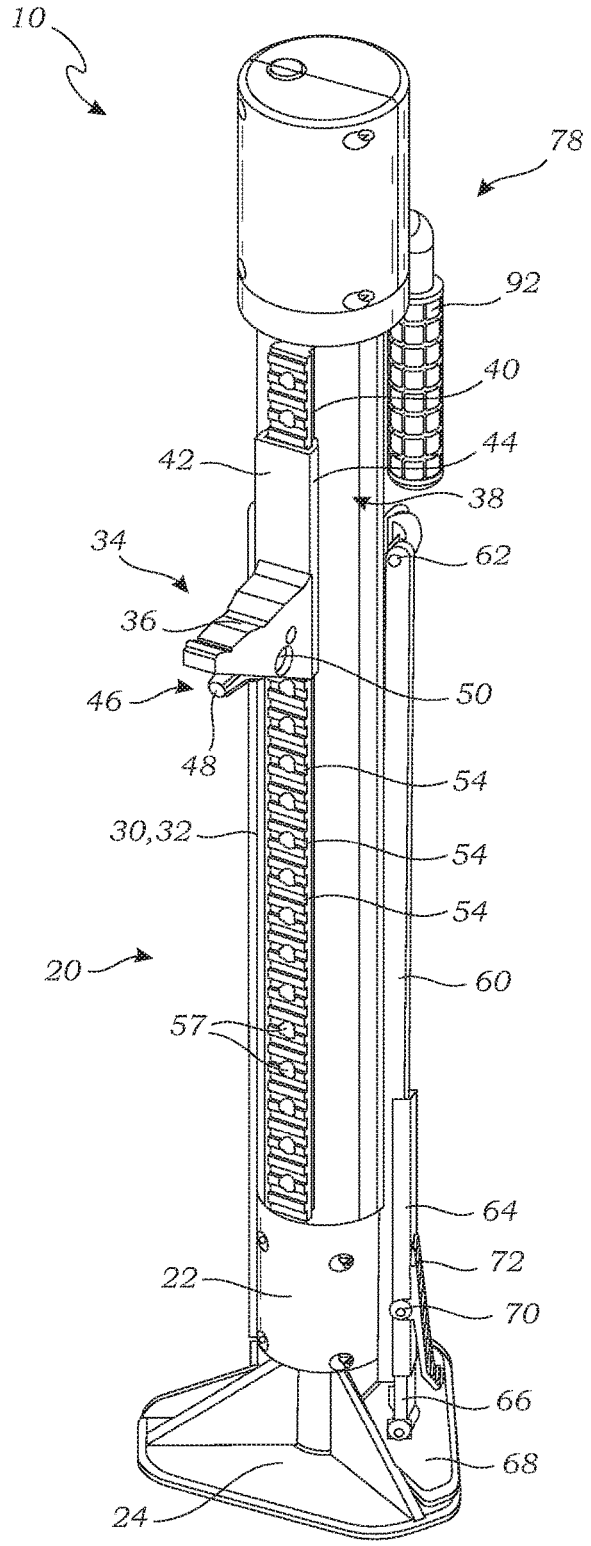
FIG. 1 is a perspective view of a vehicle lifting jack according to one embodiment of the present invention, illustrating the vehicle lifting jack in a collapsed, lowered position.
Figure 2:
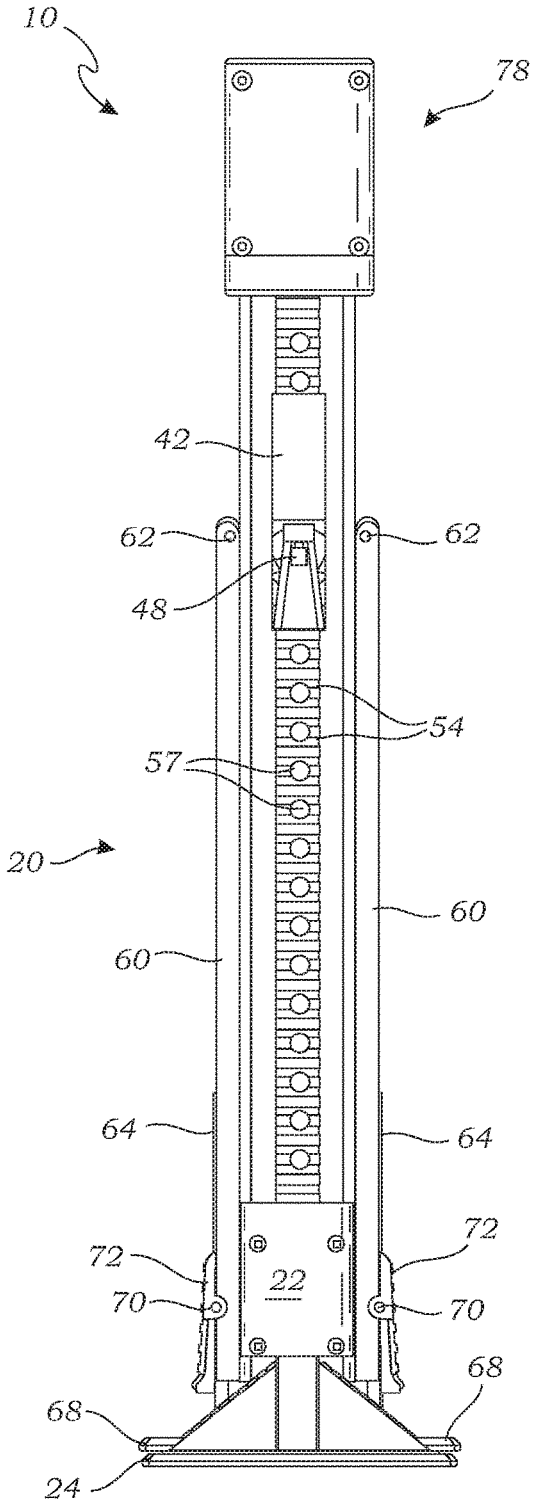
FIG. 2 is a front elevational view thereof.
Figure 3:
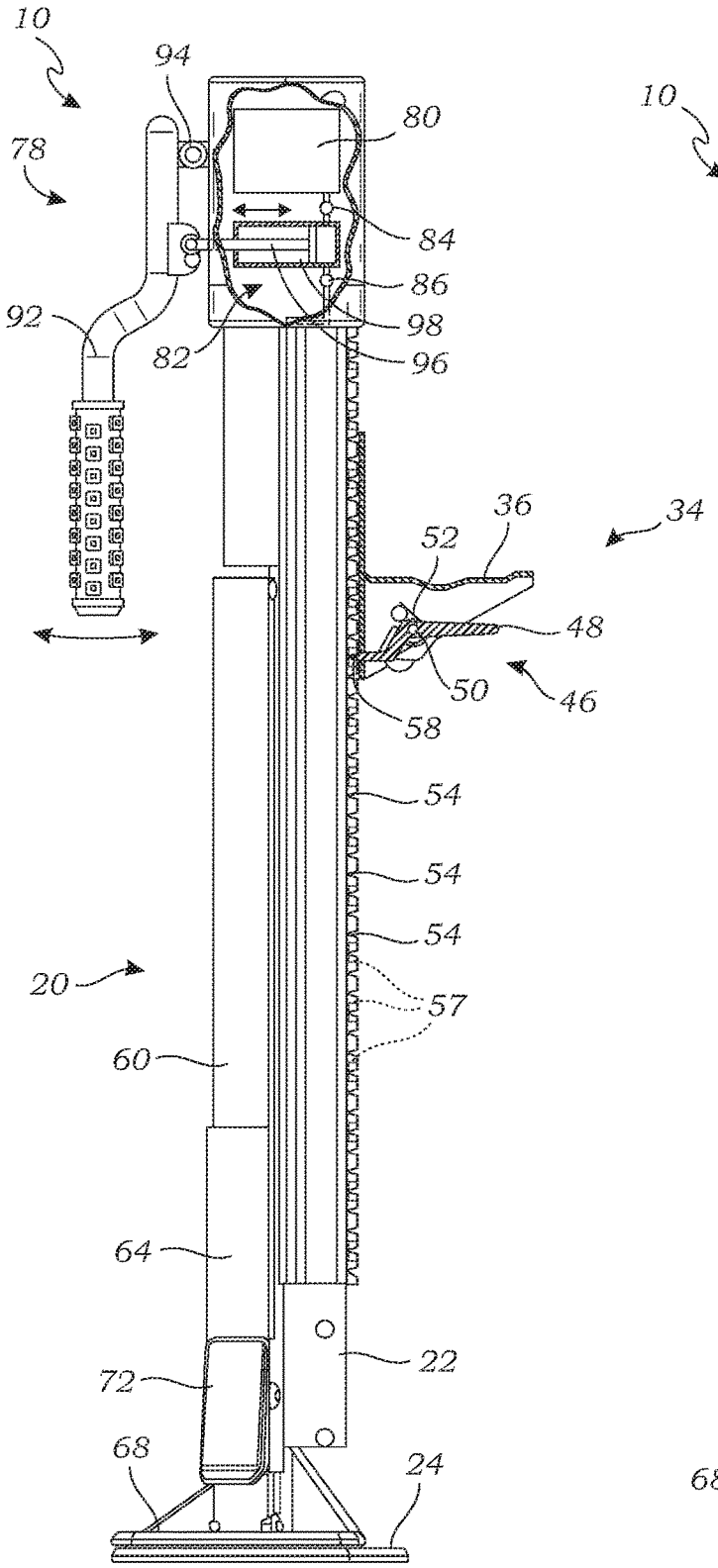
FIG. 3 is a side elevational view thereof.
Figure 4:
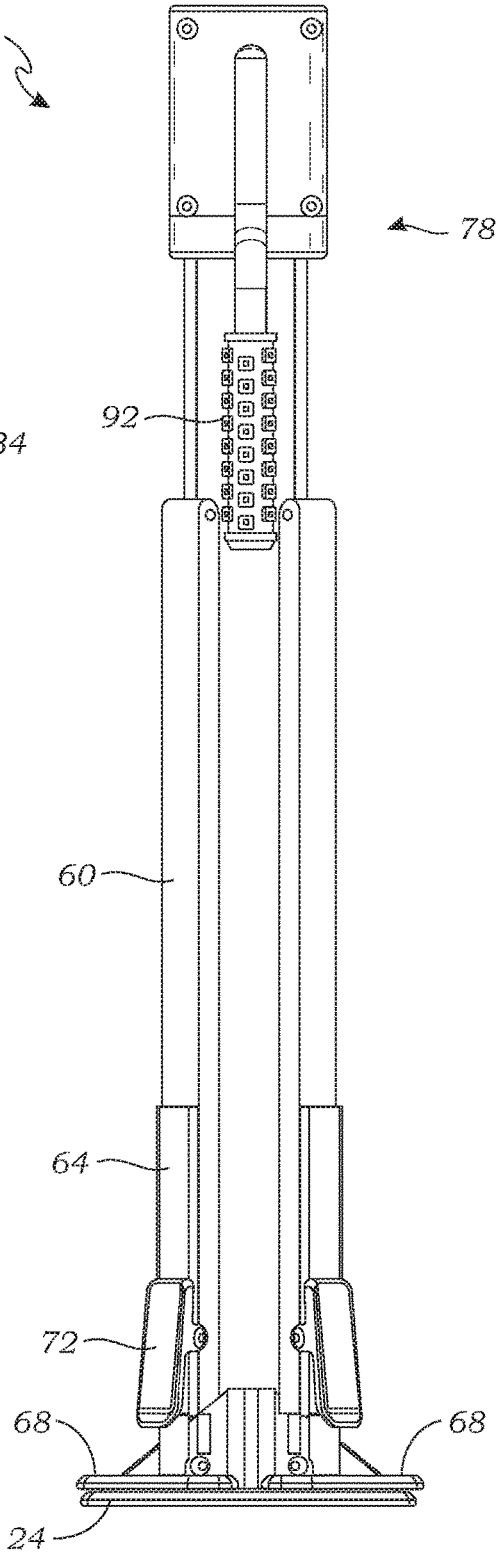
FIG. 4 is a rear elevational view thereof.

FIG. 1 is a perspective view of one embodiment of the vehicle lifting jack 10, illustrating the vehicle lifting jack 10 in a collapsed, lowered position. FIG. 2 is a front elevational view thereof. FIG. 3 is a side elevational view thereof. FIG. 4 is a rear elevational view thereof.

In the embodiment of FIGS. 1-4, the vehicle lifting jack 10 includes a lifting post 20 for lifting the vehicle, and a pair of side legs 60 for supporting the lifting post 20, though other embodiments may include a greater or fewer number of side legs, as deemed suitable by those skilled in the art. As shown in FIGS. 1-4, in the collapsed, lowered position, the pair of side legs 60 are positioned against the lifting post 20 so that the vehicle lifting jack 10 is compact for transportation and storage.

In the embodiment of FIGS. 1-4, the lifting post 20 includes a bottom element 22 and a top element 30 that are slidably mounted together so that they may move between the lowered position, as shown, and a raised position, shown in FIGS. 5-8 and discussed in greater detail below. The bottom element 22 has a support base 24 for supporting the vehicle lifting jack 10 on the ground, in this case in the form of a base plate that is shaped and sized to securely engage the ground. A secure contact with the ground is important to ensure safe lifting of the vehicle, especially when used in off-road conditions, which may require resting the vehicle lifting jack 10 on irregular dirt, shifting sand, and other difficult or irregular surfaces. The bottom element 22 further includes an upwardly extending portion 26 for slidably engaging the top element 30. In this embodiment, the top element 30 has a vehicle engaging hook 34 for engaging the vehicle when lifting the vehicle.

Each of the side legs 60 may be secured with a pivot 62 to the bottom element 22 (e.g., via a pin or other form of pivot or equivalent hinge known in the art) so that the side legs 60 extending downwardly to a lower end 64. A pair of leg extensions 66 are also provided, each slidably mounted with the lower end 64 of one of the side legs 60 and extending to a support base 68. The support base 68 may be in the form of a support plate, which may be similar to the base plate of the lifting post 20; or, alternatively, another form of base known in the art may be used. Each of the side legs 60 and the attached leg extensions 66 may pivot 62 between a collapsed position closely adjacent the lifting post 20, and an extended position wherein the side legs 60 and leg extensions 66 extend outwardly and downwardly for supporting the lifting post 20 (as shown in FIGS. 5-8).

The vehicle engaging hook 34 may be any form of structure for engaging the vehicle for lifting the vehicle. In this embodiment, the vehicle engaging hook 34 includes a hook element 36 that is adjustably mounted on an elongate body 32 of the top element 30 of the lifting post 20 via a sliding mount mechanism 38, and the jack 10 further includes a locking mechanism 46 for locking the position of the hook element 36 with respect to the top element 30. This enables the hook element 36 to be quickly adjusted to the correct height for engaging the vehicle, prior to being raised by the jack 10. In other embodiments, the hook element 36 may be fixedly attached to the lifting post 20, and it may be raised to the vehicle by raising the jack 10 up to the vehicle.

As best shown in FIG. 1, the sliding mount mechanism 38 of this embodiment includes a pair of tracks 40, best shown in FIG. 1, formed in the top element 30 of the lifting post 20, and a sliding carriage 42 that includes a pair of runners 44 shaped to slidably engage the tracks 40, and wherein the hook element 36 is mounted on the sliding carriage 42. The runners 44 may be in the form of laterally spaced elongate walls that may incline or angle inwardly to engage the tracks 40.

As best shown in FIG. 3, the locking mechanism 46 comprises a latch 48 pivotally mounted on the sliding carriage 42 via a pivot 50 so that the latch 48 pivots between a locked position wherein the latch 48 lockingly engages the top element 30 of the lifting post 20, and an unlocked position wherein the latch 48 does not so engage the top element 30. A spring 52 may be operably positioned for biasing the latch 48 towards the locked position.

As shown in FIG. 1, the locking mechanism 46 may include a plurality of lateral ridges 54 disposed along at least some of the length of the top element 30, and the latch 48 may include a tongue 56 for engaging a selected one of the lateral ridges 54 for locking the latch 48 with respect to the top element 30. The tracks 40 may be disposed on either side of the plurality of lateral ridges 54. The locking mechanism 46 may further (or alternatively) comprise a plurality of bores 57 disposed along at least some of the length of the top element 30, and the latch 48 may include a post 58 for engaging a selected one of the bores 57 for locking the latch 48 with respect to the top element 30. The tracks 40 may be disposed on either side of the plurality of bores 57, as illustrated.

Figure 5:
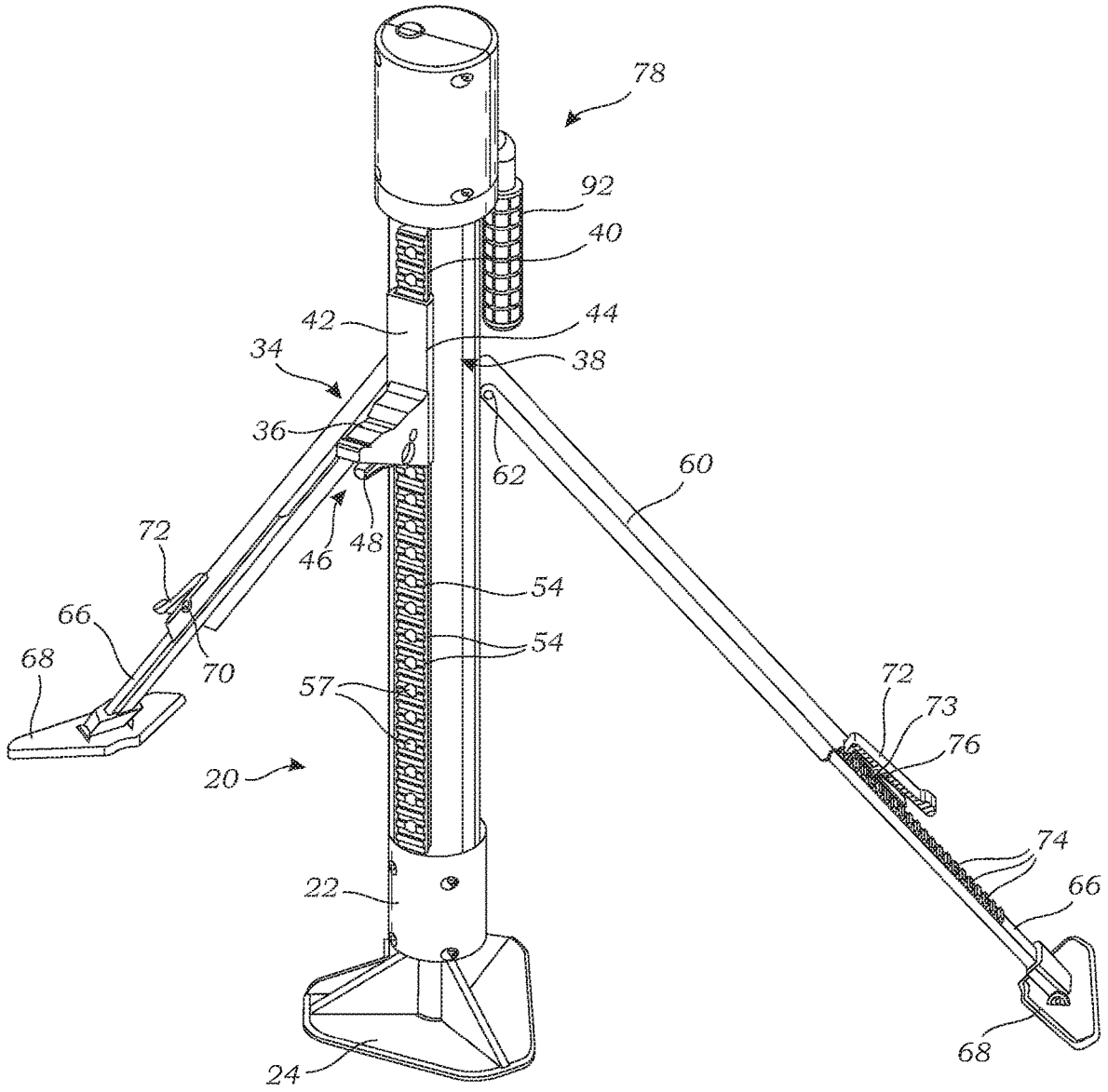
FIG. 5 is a perspective view of the vehicle lifting jack of FIG. 1, illustrating the vehicle lifting jack once a pair of side legs and associated leg extensions have been moved to an extended position for supporting the vehicle lifting jack.

FIG. 5 is a perspective view of the vehicle lifting jack 10 of FIG. 1, illustrating the vehicle lifting jack 10 once the pair of side legs 60 and the associated leg extensions 66 have been moved to an extended position for supporting the vehicle lifting jack 10. As shown in FIG. 5, in the extended position the side legs 60 extend outwardly, away from the lifting post 20, so that they collectively form a solid base from which to lift the vehicle. The side legs 60 each further include one of a pair of leg locking mechanisms 70, each for locking one of the leg extensions 66 with respect to the side leg 60, so that they remain in the extended position.

In the embodiment of FIG. 5, each of the leg extensions 66 telescopically engages one of the side legs 60. As shown in FIG. 5, in this case the side leg 60 has a generally tubular cross-section (in this case rectangular in cross section), and the leg extension is in the form or a rod or similar elongate structure that slides into the side leg (although this relationship may also be reversed). In this embodiment, each of the leg locking mechanisms 70 includes a locking tab 72 that is pivotally connected via pivot 73 to one of the side legs 60 to pivot between a locked position wherein the locking tab 72 engages locking features 74 of the leg extension 66, and an unlocked position wherein the locking tab 72 disengages the locking features 74 of the leg extension 66 and allows the leg extension 66 to be adjusted relative to the side leg 60. The leg locking mechanism 70 may further include a spring 76 for biasing the locking tab 72 towards the locked position (e.g., a leaf spring, another form of spring, a resilient element, or other non-spring mechanism known in the art).

The support base 24 of the lifting post 20 and the support bases 68 of the side legs 60 together establish a secure connection with the ground, despite difficult terrain, so that the vehicle lifting jack 10 is secure and will not tip over or otherwise slip during use. The leg extensions 66 may be adjusted with respect to the side legs 60 so that this secure connection with the ground may be made, regardless of irregularities in the ground in the location in which the jack 10 is being used.

Figure 6:
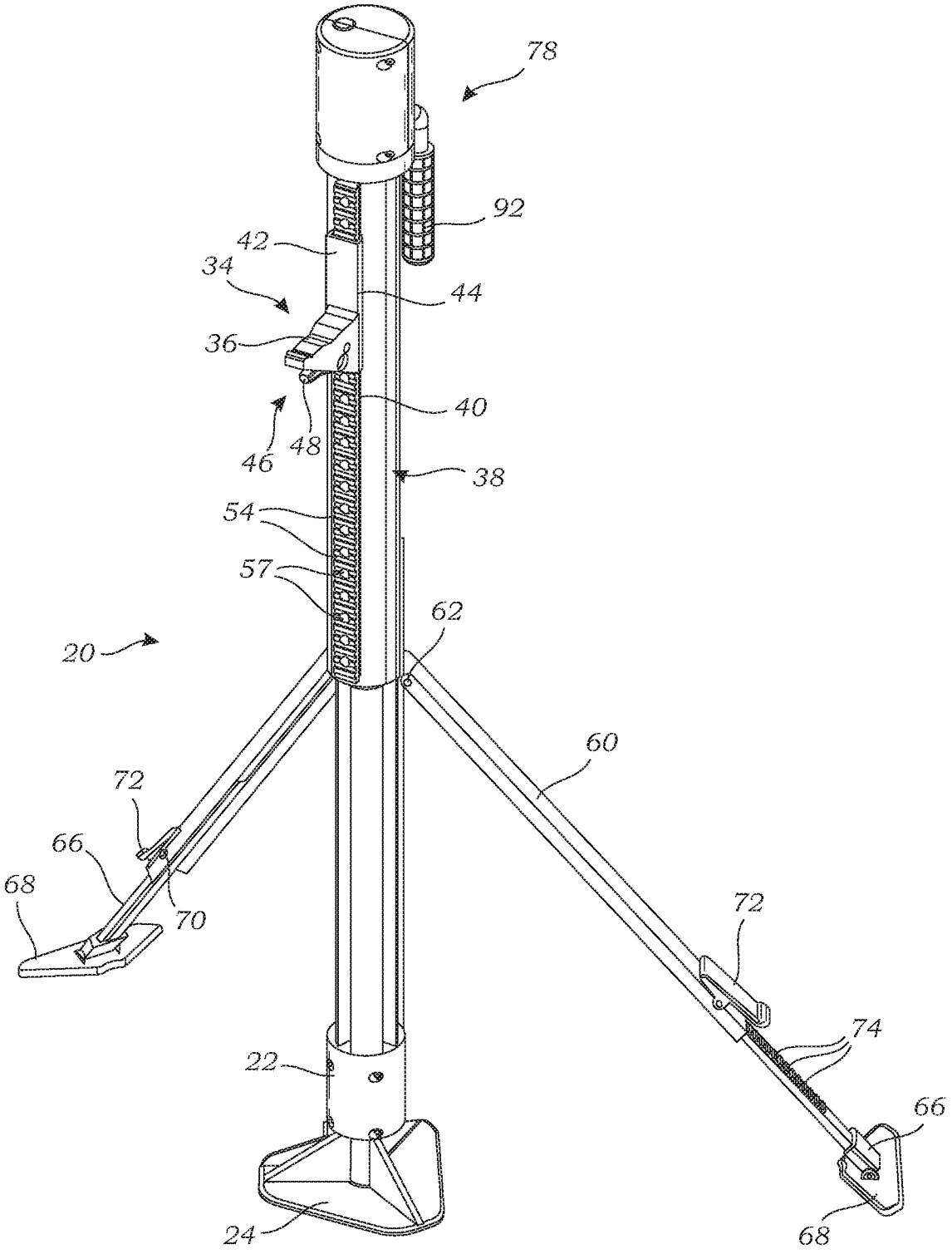
FIG. 6 is a perspective view of the vehicle lifting jack of FIG. 5, illustrating the vehicle lifting jack once a top element of a lifting post has been lifted to a raised position.
Figure 7:
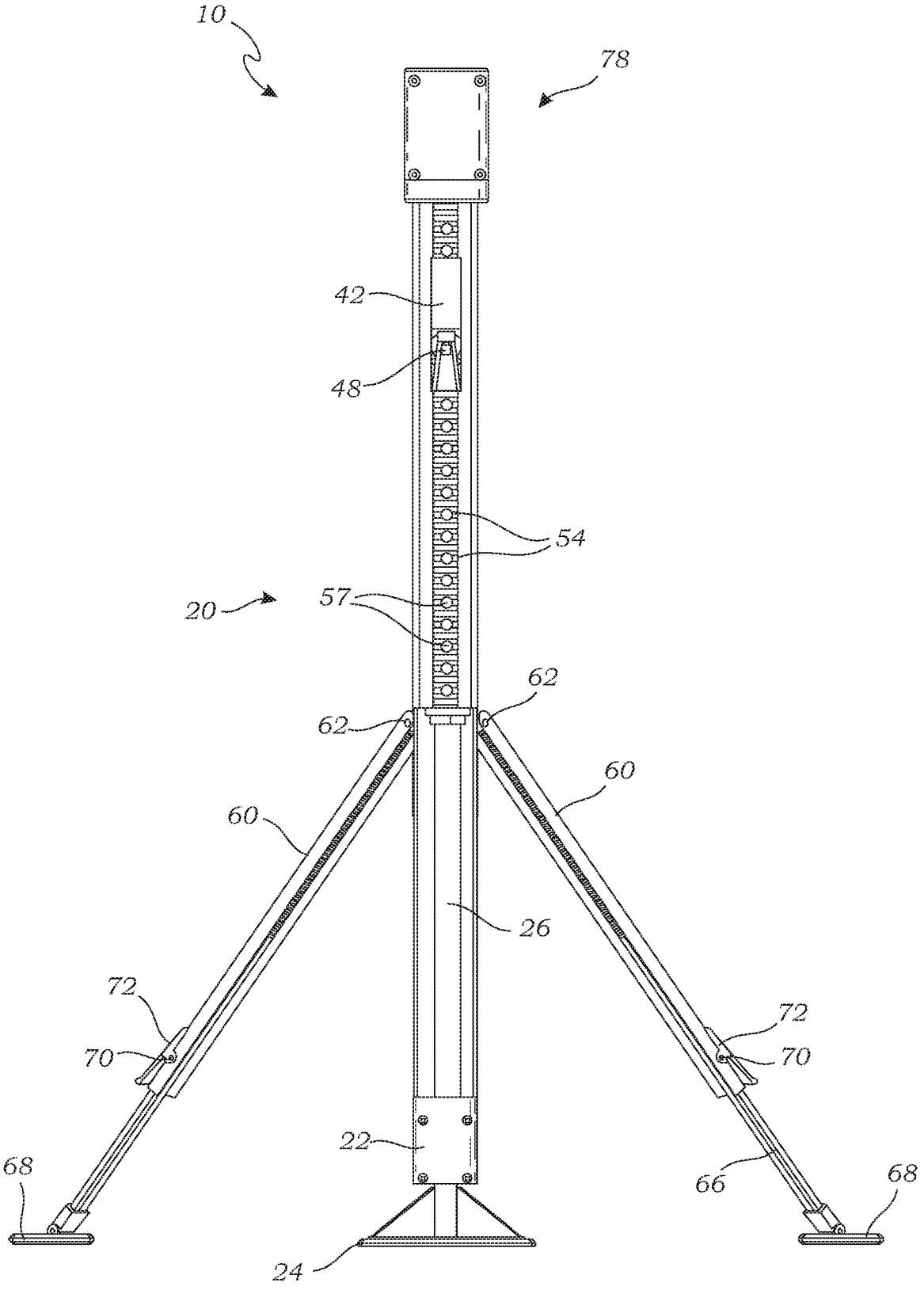
FIG. 7 is a front elevational view thereof.
Figure 8:
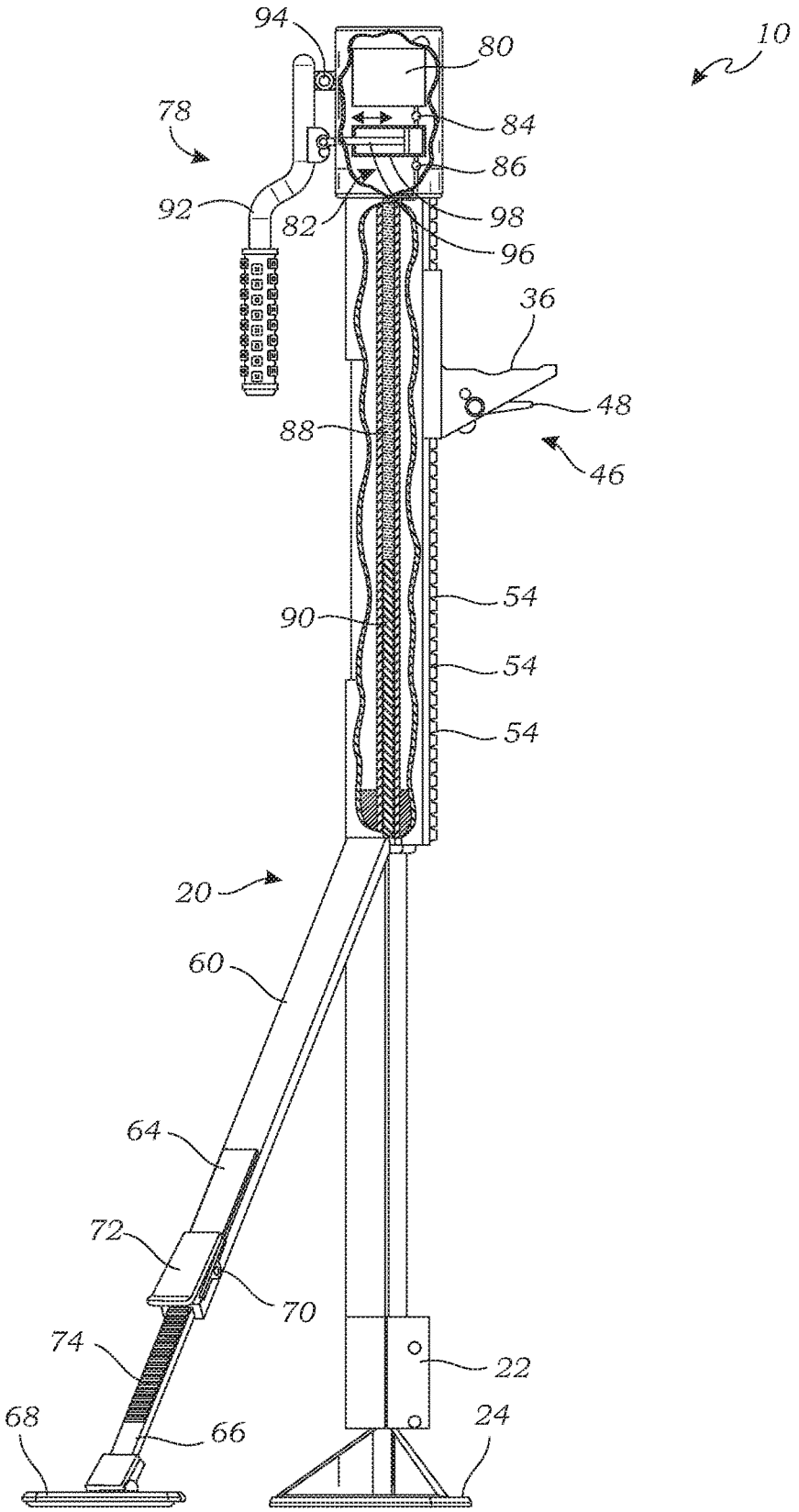
FIG. 8 is a side elevational view thereof.

FIG. 6 is a perspective view of the vehicle lifting jack 10 of FIG. 5, illustrating the vehicle lifting jack 10 once a top element 30 of a lifting post 20 has been lifted to a raised position. FIG. 7 is a front elevational view thereof. FIG. 8 is a side elevational view thereof. As shown in FIG. 6-8, the top element 30 is slidably mounted on the bottom element 22 so that the top element 30 slides longitudinally up and down on the bottom element 22, thereby raising and lowering the engaging hook 34 between the lowered and raised positions (and thereby raising and lowering the vehicle). The vehicle lifting jack 10 includes a lifting mechanism 78 for lifting the top element 30 with respect to the bottom element 22.

As best shown in FIG. 8, in this embodiment the lifting mechanism 78 includes a reservoir of fluid 80 in the top element 30 of the lifting post 20, and a pump 82 for pumping the fluid from the reservoir 80 to actuate the jack 10. A first valve 84 is operably positioned for allowing fluid to flow from the reservoir 80 into the pump 82, and a second valve 86 is positioned for allowing fluid to flow from the pump 82 into a piston chamber 88. A piston 90 extends upwardly from the bottom element 22 of the lifting post 20 and slidably engages the piston chamber 88, such that fluid flow into the piston chamber 88 moves the piston 90 and thereby lifts the top element 30 upwardly with respect to the bottom element 22.

In this embodiment, the pump 82 is manually actuated and includes a handle 92 in the form of an elongate structure (e.g., rod, cylinder, etc.) attached to the top element 30 with a handle pivot 94. The handle 92 may be operably attached to a pump piston 96 for pumping the fluid from the reservoir 80 and into the piston chamber 98. In alternative embodiments, the lifting element may include an alternative mechanism for raising and lowering the top element 30 with respect to the bottom element 22 (e.g., screw, other mechanical mechanism, or via non-mechanical mechanisms known in the art). In alternative embodiments, the vehicle lifting jack 10 may include a motor (not shown) for providing a powered lifting ability (e.g., pumping the fluid of the hydraulic actuator, turning the screw, etc.).

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. A jack for lifting a vehicle, the jack comprising:

a lifting post having a bottom element and a top element, the bottom element having a support base and an upwardly extending portion, the top element having a vehicle engaging hook;

the top element being slidably mounted on the bottom element so that the top element slides longitudinally up and down on the bottom element, thereby raising and lowering the vehicle engaging hook between a lowered position and a raised position;

a lifting mechanism for lifting the top element with respect to the bottom element;

a pair of side legs, each secured with a pivot to the bottom element and extending downwardly to a lower end;

a pair of leg extensions, each slidably mounted on the lower end of one of the side legs and extending to a support base;

each of the side legs and attached leg extensions pivoting between a collapsed position closely adjacent the lifting post, and an extended position wherein the side legs and leg extensions extend outwardly and downwardly for supporting the lifting post; and a pair of leg locking mechanisms, each for locking one of the leg extensions with respect to the side leg, so that they remain in the extended position.

2. The jack of claim 1, wherein the vehicle engaging hook includes a hook element that is adjustably mounted on the top element of the lifting post via a sliding mount mechanism, and wherein the jack further includes a locking mechanism for locking the position of the hook element with respect to the top element.

3. The jack of claim 2, wherein the sliding mount mechanism includes a pair of tracks formed in the top element of the lifting post, and a sliding carriage that includes a pair of runners shaped to slidably engage the tracks, and wherein the hook element is mounted on the sliding carriage.

4. The jack of claim 3, wherein the locking mechanism comprises: a latch pivotally mounted on the sliding carriage via a pivot so that the latch pivots between a locked position wherein the latch lockingly engages the top element of the lifting post, and an unlocked position wherein the latch does not so engage the top element; a spring for biasing the latch towards the locked position.

5. The jack of claim 4, wherein the locking mechanism further comprises a plurality of lateral ridges disposed along at least some of the length of the top element, and wherein the latch includes a tongue for engaging a selected one of the lateral ridges for locking the latch with respect to the top element.

6. The jack of claim 5, wherein the tracks are disposed on either side of the plurality of lateral ridges.

7. The jack of claim 4, wherein the locking mechanism further comprises a plurality of bores disposed along at least some of the length of the top element, and wherein the latch includes a post for engaging a selected one of the bores for locking the latch with respect to the top element.

8. The jack of claim 7, wherein the tracks are disposed on either side of the plurality of bores.

9. The jack of claim 1, wherein the lifting mechanism comprises:

a reservoir of fluid install in the top element of the lifting post;

a pump for pumping the fluid from the reservoir a first valve for allowing fluid to flow from the reservoir into the pump;

a second valve for allowing fluid to flow from the pump into a piston chamber; and a piston extending upwardly from the bottom element of the lifting post, the piston slidably engaging the piston chamber, such that fluid flow into the piston chamber pushes the piston and thereby the bottom element downwardly with respect to the top element.

10. The jack of claim 9, wherein the pump includes a handle attached to the top element with a handle pivot, the handle being operably attached to a pump piston for pumping the fluid from the reservoir and into the piston chamber.

11. The jack of claim 1, wherein each of the leg extensions telescopically engages one of the side legs, and wherein each of the leg locking mechanisms includes a locking tab that is pivotally mounted to one of the side legs to pivot between a locked position wherein the locking tab engages locking features of the leg extension, and an unlocked position wherein the locking tab disengages the leg extension and allows the leg extension to be adjusted relative to the side leg.

12. The jack of claim 11, wherein the leg locking mechanism further includes a spring for biasing the locking tab towards the locked position.

* * * * *